United States Patent [19]

Goldstein

[11] 4,003,387

[45] Jan. 18, 1977

[54] CIGARETTE FILTER HOLDER

[75] Inventor: Jerome J. Goldstein, Denver, Colo.

[73] Assignee: Aquafilter Corporation, Farmington Hills, Mich.

[22] Filed: Feb. 26, 1976

[21] Appl. No.: 661,630

Related U.S. Application Data

[63] Continuation of Ser. No. 536,880, Dec. 27, 1974, abandoned.

[52] U.S. Cl. ..... 131/173; 131/4 R

[51] Int. Cl.[2] ..... A24F 13/02

[58] Field of Search ..... 131/173, 187, 261 R, 131/4 R; 206/242, 469; 220/265, 266

[56] References Cited

UNITED STATES PATENTS

| | | | |
|---|---|---|---|
| 2,911,984 | 11/1959 | Gerard et al. | 131/173 |
| 3,375,920 | 4/1968 | Shaw | 131/4 R X |
| 3,797,644 | 3/1974 | Shaw | 206/242 |

FOREIGN PATENTS OR APPLICATIONS

| | | | |
|---|---|---|---|
| 1,283,296 | 12/1961 | France | 220/265 |
| 1,461,573 | 11/1966 | France | 131/173 |
| 883,236 | 11/1961 | United Kingdom | 220/265 |
| 1,142,965 | 2/1969 | United Kingdom | 220/265 |

*Primary Examiner*—John F. Pitrelli
*Attorney, Agent, or Firm*—Wolf, Greenfield & Sacks

[57] ABSTRACT

A cigarette filter holder includes a cigarette receiving socket at one end and a mouthpiece at the other end. The interior of the holder includes a fibrous filtering material impregnated with water. The mouthpiece end of the holder is formed with an integrally formed removable plug, which upon removal provides an opening to the interior of the cigarette filter.

4 Claims, 3 Drawing Figures

CIGARETTE FILTER HOLDER

This is a continuation, of application Ser. No. 536,880, filed Dec. 27, 1974 now abandoned.

BACKGROUND OF THE INVENTION

This invention relates to an improvement in cigarette filtering devices and particularly those devices which are prepackaged with water impregnated fibrous materials. More specifically, the present invention is designed to provide certain improvements over the filter structure illustrated and described in United States Letters Pat. Nos. 3,797,644 and 3,375,920. The cigarette filters described in the above mentioned U.S. Patents are intended for mass production. Consequently, it is important to minimize the expense of producing cigarette filters of the type therein described. The means for removably sealing the ends of these cigarette filters heretofore used involved techniques of significant expense. Thus, for example, in U.S. Pat. No. 3,797,644 there is illustrated a means for sealing the mouthpiece end of the filter with a stripable plastic film. Utilizing that sealing technique involves manufacturing steps over and above the manufacturing steps required to form the filter. More specifically, the technique therein disclosed requires the dipping of the already molded plastic shell into a plastic film forming material to form a stripable cover. This additional fabrication step thus involves the use of additional plastic material such, for example, as mixtures of cellulose acetate butyrate and dioctyl phthalate. Additionally, it involves delays in the manufacturing process for drying these covers.

SUMMARY OF THE INVENTION

The present invention resides in providing a improved cigarette filter holder in which the mouthpiece end of the filter holder is integrally molded with a sealing means which may be twisted, ruptured or otherwise removed from the main body of the holder to form an air passage in the mouthpiece end of the filter. Thus, it is an object of the present invention to provide an improved water impregnated cigarette filtering device which has prolonged shelf life and which has a comparatively inexpensively formed sealing means at the mouthpiece end of the cigarette filter.

A further object of the present invention is to provide an improved cigarette filtering device technique for manufacturing the device in which the use of multiple materials for sealing the mouthpiece end of the filter is eliminated and in which defective seals may be minimized. One further object of the present invention is to provide efficiently made cigarette filters.

DESCRIPTION OF THE DRAWINGS

The foregoing and other objects and advantages of this invention will be understood more fully from the following detailed description of a preferred embodiment of the invention, with specific references to the accompanying drawings, in which.

DESCRIPTION OF THE PREFERRED EMBODIMENT

Figure 1:
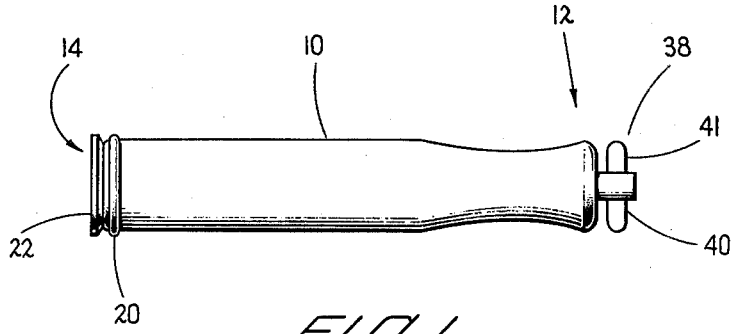
FIG. 1 is a plan view of a cigarette filter of the type described, embodying the invention.

FIG. 1 illustrates a preferred embodiment of the present invention. In particular the preferred embodiment is a disposable cigarette filter holder in which the filtering material comprises a fibrous material pre-impregnated with water. In general, this type of cigarette filter holder has been described in U.S. Letters Pat. Nos. 3,137,303, 3,379,920 and 3,797,644. The filter includes an elongated casing 10, formed from a suitable plastic material. The casing 10 has an annular cigarette receiving socket 14 at one end and a tapered mouthpiece 12 at the other end. In the embodiment shown, a cylindrical metal sleeve 16 having an outwardly flared lip 18 is fitted firmly into the cigarette receiving end of the casing 10 with the lip 18 engaging a lip 20 formed on the casing. Sleeve 16 defines the cigarette receiving socket 14 and is proportioned to receive a cigarette in snug fit. A fibrous material 21 is disposed in the casing rearwardly of the sleeve 16.

The completed filter is closed at its socket end 14 with a cap 22 having a continuous sidewall 24 which is closed at the bottom by an integral and continuous dome-like button 26. The upper edge of the sidewall 24 is outwardly and arcuately flared to define a lip 28. This lip 28 is spaced from the lip 18 on the sleeve 16 to define a recess 30 of sufficient dimension to permit one to insert a fingernail between these two lips for removal of cap 22. The cap is formed of a suitable substantially gas impervious plastic material having sufficient flexibility and resilience to permit insertion and removal of the cap with relative ease. For example, polyethylene is an appropriate plastic material for use in making the cap 22.

The water impregnated fibrous plug 21 is made of suitable blends of cotton fibers and is secured between the inner end of the sleeve 16 and a narrow shoulder 30 formed on the inner surface of the casing 10 preferably at the junction of the cylindrical section 31 of the casing and the tapered section 32 of the casing. The flange or shoulder 30 should be of sufficient depth to engage the periphery of the plug 21 at one end to prevent it from being forced into the tapered section 32 of the filter.

The plug 21 is secured in this position by the engagement of the other end of the fibrous mass with the annular wall 34 of the sleeve 16.

Figure 2:
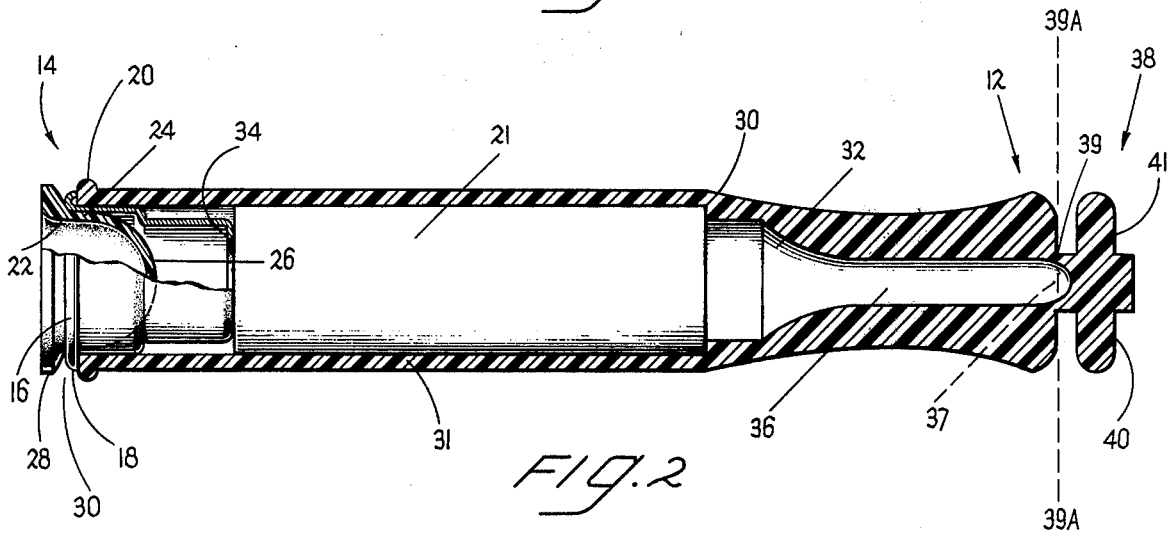
FIG. 2 is an illustration of the filter, in section, taken along the line 2—2 of FIG. 3.
Figure 3:
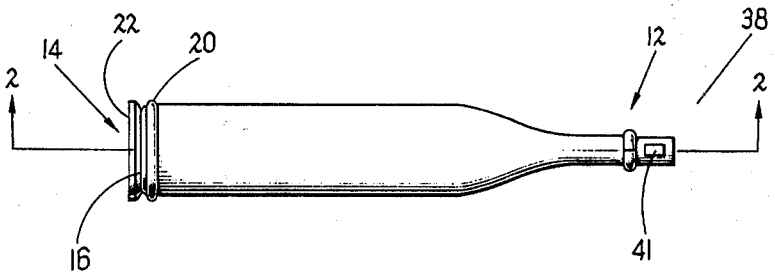
FIG. 3 is an elevational view looking ffom the top of FIG.1.

A tapered passage 36 extends axially in the tapered section 32 from the adjacent end of the fibrous plug 21 to the tip 37 of the mouthpiece 12. The passage 36 is closed at this one end by a plug 38. The plug 38 is integrally formed with and of the same material as the casing 10. The plug has a cross sectional dimension slightly greater than the dimensions of the passage 36 and the casing of the tip end 37. The plug 38 is formed with an annular segment 39 that has a thickness less than the adjacent portion of the plug 38 and the casing 10. This segment 39 defines the end of the passage 36 in the tip and also defines an annular line along which the plug 38 may be severed from the main portion of the integrally formed casing 10. The passage 36 extends slightly beyond the plane in which the annular segment lies. This extension is illustrated to the right of line 39A-39A of FIG. 2. Thus, upon removal of the plug 38 along passage 36, the passage 36 is open through the mouthpiece end of the filter.

The plug 38 is preferably cylindrical in shape along the main body portion of its length. A pair of extending flanges or wings 40 and 41 are integrally formed with the main body of the plug 38 and extend normal to the axis of the main body of the plug thereby providing finger grip means for engaging the plug 38.

The plug may readily be severed from the main portion of the cigarette holder casing 10 by engaging the flanges or wings 40 and 41 between a thumb and forefinger and twisitng the plug 38 axially relative to the filter casing 10. This will cause the plug 38 to rupture or twist from the casing 10 along the annular segment 30 thereby opening the passsage 36. Upon removal of the plug and cap 22 the filter is ready for insertion of a cigarette and use.

It should be understood that the foregoing description of the invention is intended merely to be illustrative thereof and that other embodiments and modifications may be apparent to those skilled in the art without departing from its spirit.

Having thus described the invention, what I desire to claim and secure by Letters Patents is:

1. A disposable cigarette holder construction comprising:

an elongated plastic cigarette holder having an opening at one end shaped to receive the tip of a cigarette, a removable cap extending over said opening, said holder also having a passage extending from said opening to the other end of said holder, a fluid containing member positioned in said passage, and a removable plug integrally formed with said holder removably closing said passage at said other end, said other end of said holder including means defining an end surface extending normal to the axis of the holder, wherein said integrally formed removable plug comprises a member extending from the other end of said holder and integrally formed with said holder along an annular segment having a thickness less than adjacent portions of said plug and holder, with said segment lying coplanar with said end surface, defining the end of said passage and adapted upon removal to provide an opening to said passage through said other end, said annular segment, when removed, defines an annular surface that is flush with the end surface surrounding the annular surface, said plug extending lengthwise of said holder with wings projecting outwardly therefrom to provide finger grips for twisting said plug, said passage terminating in an end with progressively smaller radii defining the end surface thereof and extending into the plug a slight distance which is less than the distance between the end surface of said holder and a center line of said wings which is normal to the axis of said holder.

2. A disposable cigarette holder construction comprising:

an elongated hollow cigarette holder having an opening at one end to receive the tip of a cigarette and a passage therethrough communicating with the opening and terminating at the other end of the holder, said holder including a tapered section at said other end defining a mouthpiece and having a flattened shape, a fluid containing member positioned in said passage, a removable plug integrally formed with said holder by means of an annular segment, said passage terminating in an end surface extending into the plug a distance less than the diameter of the passage at said mouthpiece end, said passsage termination in part defining the annular segment which has a thickness less than adjacent portions of said plug and holder, said plug has wings extending along a center line that is normal to the axis of the holder, said passage terminating a distance less than the distance between an end surface of said holder and the center line of said wings, said flattened shape extends along a first plane and said wings define a second plane coplanar with the first plane.

3. A disposable cigarette holder construction as set forth in claim 2 wherein said other end of said holder includes means defining an end surface extending normal to the axis of the holder with said segement lying coplanar with said end surface.

4. A disposable cigarette holder construction as set forth in claim 3 wherein said passage terminates in a paraboloid shape having a surface sloped relative to the axis at the annular segment.

* * * * *